US009579665B2

(12) United States Patent
Madsen et al.

(10) Patent No.: US 9,579,665 B2
(45) Date of Patent: Feb. 28, 2017

(54) CENTRIFUGAL SEPARATOR AND AN OUTLET ELEMENT FOR A CENTRIFUGAL SEPARATOR

(75) Inventors: Bent Madsen, Gentofte (DK); Henrik Reiff, Farum (DK)

(73) Assignee: ALFA LAVAL CORPORATE AB, LUND (SE)

( * ) Notice: Subject to any disclaimer, the term of this patent is extended or adjusted under 35 U.S.C. 154(b) by 225 days.

(21) Appl. No.: 13/884,838

(22) PCT Filed: Nov. 14, 2011

(86) PCT No.: PCT/DK2011/050436
§ 371 (c)(1),
(2), (4) Date: Aug. 2, 2013

(87) PCT Pub. No.: WO2012/062337
PCT Pub. Date: May 18, 2012

(65) Prior Publication Data

US 2013/0310242 A1 Nov. 21, 2013

(30) Foreign Application Priority Data

Nov. 12, 2010 (DK) ..... 2010 70484

(51) Int. Cl.
*B04B 11/00* (2006.01)
*B04B 1/20* (2006.01)
(Continued)

(52) U.S. Cl.
CPC ..... *B04B 11/00* (2013.01); *B04B 1/20* (2013.01); *B04B 7/02* (2013.01); *B04B 11/02* (2013.01);
(Continued)

(58) Field of Classification Search
CPC .... B04B 1/20; B04B 7/02; B04B 7/04; B04B 11/00; B04B 11/02; B04B 2001/2083; B04B 2001/2075
(Continued)

(56) References Cited

U.S. PATENT DOCUMENTS 3,580,492 A * 5/1971 Schnittger et al. ..... 494/53
3,623,656 A 11/1971 Lavanchy
(Continued)

FOREIGN PATENT DOCUMENTS

CN 101203318 A 6/2008
CN 101715370 A 5/2010
(Continued)

OTHER PUBLICATIONS

European International Preliminary Report on Patentability for corresponding Application No. PCT/DK2011/050436, date of completion Feb. 7, 2013.
(Continued)

*Primary Examiner* — Charles Cooley
*Assistant Examiner* — Shuyi S Liu
(74) *Attorney, Agent, or Firm* — MKG, LLC

(57) ABSTRACT

A centrifugal separator includes a rotating body rotating in use around an axis. The rotating body comprises a bowl, which comprises a base at one longitudinal end of said bowl, said base defining a rear longitudinal area. An outlet passage extends through the base and an outlet housing is provided in the rear longitudinal area. The outlet housing is communicating with the outlet passage to receive liquid therefrom and the outlet housing has an outlet opening discharging in use liquid from the rotating body. The outlet opening comprises a weir edge defining in normal use a level of a surface of a liquid in the bowl. The outlet housing is rotatable around
(Continued)

an adjustment axis and the outlet opening is placed in a side wall offset from the adjustment axis.

29 Claims, 5 Drawing Sheets

(51) Int. Cl.
*B04B 7/02* (2006.01)
*B04B 11/02* (2006.01)

(52) U.S. Cl.
CPC ..... *B04B 2001/2075* (2013.01); *B04B 2001/2083* (2013.01)

(58) Field of Classification Search
USPC ..... 494/38, 41, 56, 57
See application file for complete search history.

(56) References Cited

U.S. PATENT DOCUMENTS

| | | | | |
|---|---|---|---|---|
| 3,955,756 | A | 5/1976 | Hiller | |
| 4,764,163 | A * | 8/1988 | Caldwell | 494/56 |
| 5,171,205 | A * | 12/1992 | Monkenbusch | 494/10 |
| 5,257,968 | A | 11/1993 | Caldwell | |
| 5,593,377 | A | 1/1997 | Figgener et al. | |
| 7,022,061 | B2 | 4/2006 | Leung et al. | |
| 7,255,670 | B2 | 8/2007 | Hensley et al. | |
| 2004/0058796 | A1 | 3/2004 | Feldkamp et al. | |
| 2004/0072668 | A1 | 4/2004 | Leung | |
| 2010/0105536 | A1 | 4/2010 | Sudhues et al. | |

FOREIGN PATENT DOCUMENTS

| | | | | |
|---|---|---|---|---|
| DE | 3344432 | A | 6/1985 | |
| DE | 3822983 | A1 | 1/1990 | |
| DE | 4130759 | A | 3/1993 | |
| DE | 4320265 | A | 12/1994 | |
| DE | 19962645 | A | 7/2001 | |
| DE | 10021983 | A | 11/2001 | |
| JP | 2001314779 | A | 11/2001 | |
| JP | 2005074375 | A * | 3/2005 | B04B 1/20 |
| SE | 514010 | C2 | 12/2000 | |
| SU | 1071212 | A3 | 1/1984 | |
| WO | 03074185 | A1 | 9/2003 | |
| WO | 2008138345 | A1 | 11/2008 | |
| WO | WO 2008138345 | A1 * | 11/2008 | B04B 1/20 |
| WO | WO 2009072209 | A1 * | 6/2009 | |
| WO | 2009127212 | A1 | 10/2009 | |
| WO | 2010019418 | A2 | 2/2010 | |

OTHER PUBLICATIONS

Danish Search Report for corresponding Application No. PA2010 70484, date of completion Jun. 17, 2011.
European International Search report for corresponding Application No. PCT/EP03/02237, date of completion May 19, 2003.
PCT International Search Report for corresponding Application No. PCT/DK2011/050436, date of completion Feb. 15, 2013.
International Search Report from PCT/DK2011/050436, dated Feb. 26, 2013.
Search Report from corresponding Chinese Patent Application No. 201180054585.X, dated Jan. 15, 2014.
Decision on Grant for Russian Patent Application No. 2013126585/01(039469), dated Aug. 1, 2014.
Office Action from corresponding Japanese Patent Application No. 2013-538075, dated Nov. 11, 2014.
Office Action from corresponding Korean Patent Application No. 10-2013-7014972, dated Feb. 24, 2015.

* cited by examiner

CENTRIFUGAL SEPARATOR AND AN OUTLET ELEMENT FOR A CENTRIFUGAL SEPARATOR

FIELD OF THE INVENTION

The present invention relates to a centrifugal separator, in particular to a decanter centrifuge, including a body configured to rotate during use in a direction of rotation around a horizontal axis of rotation. The axis of rotation extends in a longitudinal direction of the rotating body. The rotating body includes a bowl. The bowl defines a base provided at one longitudinal end of the bowl. The base faces a first rear longitudinal area of the centrifugal separator rear of the base. A first outlet passage extends through the base. A first outlet housing is provided in the first rear longitudinal area. The first outlet housing communicates with the first outlet passage to receive liquid from the first outlet passage. The first outlet housing has a first outlet opening configured to discharge liquid from the rotating body during operation. The first outlet opening includes a first weir edge defined in normal use, a level of a surface of a liquid in the bowl.

The present invention further relates to an outlet element for a centrifugal separator.

BACKGROUND OF THE INVENTION

A centrifugal separator of this art is known from WO-A-2008/138345, which discloses a centrifugal separator having a projecting casing mounted on an external side face of the base or base plate of the separator. The casing has an open side with a discharge opening placed at an angle relative to the plane of the base plate to allow liquid to be discharges in a partly tangential direction to recover energy from the discharged liquid. In the discharge opening a weir plate is fitted to define the level of liquid in the bowl of the centrifugal separator. In order to adjust said level the weir plate must be substitute by a different weir plate of a different size and thus different weir plate must be kept in stock to provide the possibility of adjusting the level of the liquid in the bowl.

SUMMARY

There is disclosed herein a centrifugal separator that includes a first outlet housing being rotatable around a first adjustment axis. The first outlet housing includes a first side wall offset from the first adjustment axis. The first outlet opening is present in the first side wall. The centrifugal separation enables the level of the liquid in the bowl to be adjusted by rotating the outlet housing around the adjustment axis, as such rotation entails an adjustment of the radial distance of the weir edge from the axis of rotation.

It should be understood that the expression "level" refers to the radial distance from the axis of rotation, and by analogy to the field of gravity of earth "up" refers to a direction towards the axis of rotation and "down" refers to an opposite direction.

In a preferred embodiment the first outlet housing is cylindrical having a cylinder surface provided by said first side wall and a cylinder axis coaxial with the adjustment axis, and further the first outlet housing is preferably circular cylindrical. This provides for a simple construction and accordingly cost efficient production.

In use the liquid flows over the weir edge in a substantially tangential direction opposite to the direction of movement of the outlet housing due to the rotation of the bowl, because the outlet housing is set in a position relative to the adjustment axis so that the weir edge is positioned further from the axis of rotation than an opposite edge of the outlet opening, and the weir edge is the trailing edge of the outlet opening relative to the rotational movement of the bowl. During adjustment of the outlet housing around the adjustment axis the outlet housing should not be brought into a position, in which the edge opposite the weir edge is as far (or further) from the axis of rotation as (or than) the weir edge, because liquid would in that case flow over said opposite edge, which is not intended. This puts a limit to the range of adjustment for the outlet housing and hence a limit to the range of radial distance from the axis of rotation in which the weir edge may be placed. The larger an angle the outlet opening extends the more limited is the range of adjustment for the outlet housing. On the other hand, the outlet opening and especially its angular range of extension around the adjustment axis should be so large that the outlet opening does not run full during normal operation, but an air-vent should always be left between the surface of the out-flowing liquid and the edge opposite the weir edge.

Thus preferably the first outlet opening is extending over an angle of 30° to 75°, more preferably 45° to 60°, around the adjustment axis.

In one embodiment, the first weir edge is extending along a generator of the cylinder surface. Hereby is provided for distribution of the out-flowing liquid along the length of the weir edge, when the cylinder axis is parallel to the axis of rotation.

In one embodiment, the first outlet housing has a closed end wall distal from the base, the adjustment axis is passing through said end wall. Thus all the liquid flowing through the outlet housing flows through the first outlet opening.

In one embodiment, the first outlet housing has an axial length in the direction of the first adjustment axis, and the first outlet opening is extending an axial length in the direction of the adjustment axis shorter than the axial length of the first outlet housing. Thus it is possible to provide the first outlet opening at a distance from the outer surface of the base In one embodiment the first outlet housing is part of an outlet element having a connecting piece rotatably connected to the base. Preferably the outlet element is tubular, having an outer circumferential collar separating the outlet housing and the connecting piece.

The outlet housing may be mounted on a mounting plate attached to the base as it is per se known from the above mentioned WO-A-2008/138345.

In one embodiment, an indicator indicating the angular position of the outlet housing relative to the adjustment axis is provided for practical reasons.

In one embodiment a fastener is provided for preventing rotation of the outlet housing around the adjustment axis. This ensures that the outlet housing does not rotate unintentionally.

The adjustment axis is in one embodiment parallel to the axis of rotation.

In an embodiment, in which the centrifugal separator is intended for separating two phases of liquid of different density as disclosed e.g. in WO 2009/127212, according to the present invention a second outlet passage is extending through the base. The second outlet passage communicates with a conduit extending to a second outlet opening discharging in use liquid from the rotating body in a second rear longitudinal area rear of the first rear longitudinal area. The conduit includes a second outlet housing rotatable around a second adjustment axis. The outlet housing includes a side wall offset from the second adjustment axis. The second outlet opening is placed in the side wall. The benefits of the present invention are obtained for the outlets for both the liquid phases.

In an embodiment a shaft part of the rotating body extends coaxially with the axis of rotation from the base, and the shaft part carries a flange, whereby the conduit extends through the flange, and the outlet housing is provided on a distal side of the flange relative to the bowl, the flange separating the first and the second rear longitudinal area. The flange supports the conduit and prevent a re-mixing of the two phases of liquid separated by the centrifugal separator.

In one embodiment, the centrifugal separator includes a casing housing the rotating body, and the casing includes a proximal compartment for receiving a liquid discharged from the rotating body though the first outlet opening, and a distal compartment for receiving liquid discharged from the rotating body through the second outlet opening, the compartments being separated by a partition. Thus the proximal compartment extends the first rear longitudinal area and the distal compartment extends the second rear longitudinal area. In an embodiment where a flange as mentioned is present the flange is preferably surrounded by an annular sealing, the casing including the partition is divided in at least two parts comprising a lid, and the partition engages the annular sealing, when the lid is in a closed position. Hereby it is further prevented that the two phases are re-mixed. The object is further obtained by an outlet element for a centrifugal separator, comprising a connecting piece providing for rotatable connection of the outlet element for the outlet element to be rotatable around an adjustment axis, an outlet housing comprising a side wall offset from said adjustment axis, an outlet opening provided in said side wall, said outlet opening comprising a weir edge.

BRIEF DESCRIPTION OF THE DRAWINGS

In the following the invention will be described in more detail by way of examples of embodiments with reference to the schematic drawing, in which.

DETAILED DESCRIPTION

Figure 1:
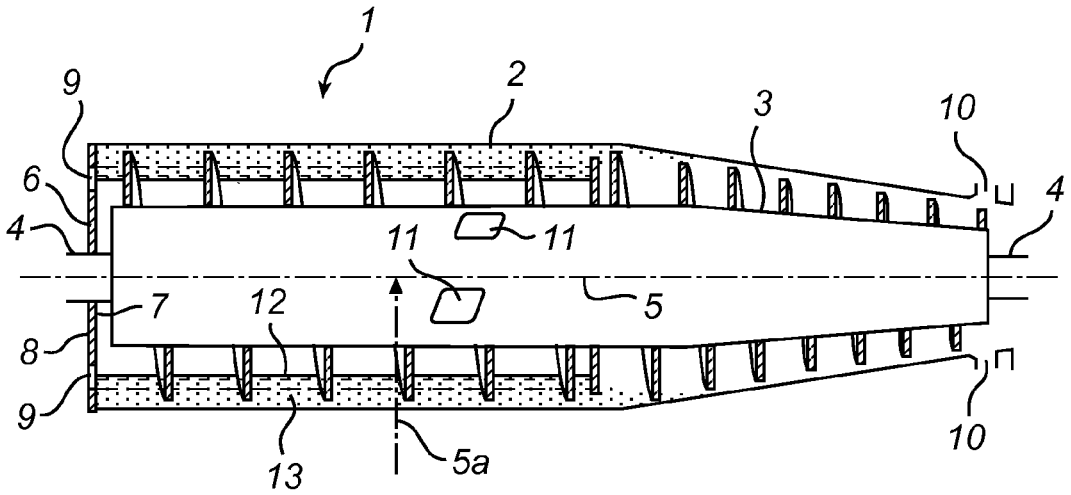
FIG. 1 shows a longitudinal section of a rotating body of a prior art decanter centrifuge.

A rotating body 1 of a prior art centrifugal separator or decanter centrifuge schematically shown in FIG. 1 includes a bowl 2 and a screw conveyor 3 which are mounted on a shaft 4 for rotation around a horizontal axis 5 of rotation. The axis 5 of rotation extends in a longitudinal direction of the bowl 2. Further, the rotating body 1 has a radial direction 5*a* extending perpendicular to the longitudinal direction.

For the sake of simplicity directions "up" and "down" are used herein as referring to a radial direction towards the axis 5 of rotation and away from the axis 5 of rotation, respectively.

The bowl 2 comprises a base plate 6 provided at one longitudinal end of the bowl 2, which base plate 6 has an internal side 7 and an external side 8. The base plate 6 is provided with a plurality of liquid phase outlet passages 9 having external openings in the external side 8 of the base plate. Furthermore the bowl 2 is at an end opposite to the base plate 6 provided with solid phase discharge openings 10.

The screw conveyor 3 comprises inlet openings 11 for feeding a feed e.g. slurry to the rotating body 1, the slurry comprising a light or liquid phase 12 and a heavy or solid phase 13. During rotation of the rotating body 1 as previously described, separation of the liquid phase 12 and solid phase 13 phases is obtained. The liquid phase 12 is discharged through the outlet passages 9 in the base plate 6, while the screw conveyor 3 transports the solid phase 13 towards the solid phase discharge openings 10 through which the solid phase 13 is eventually discharged.

Figure 2:
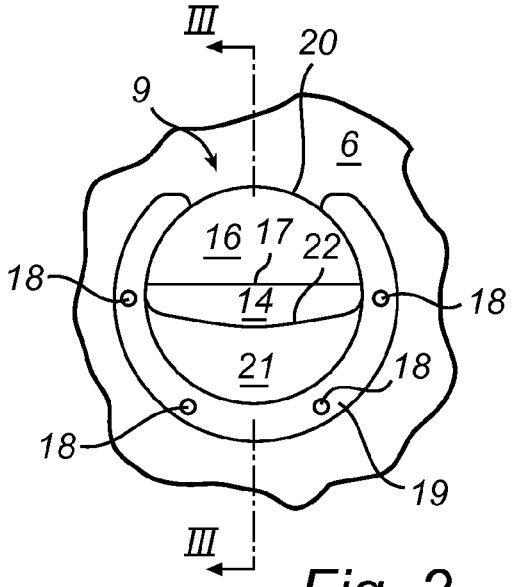
FIG. 2 shows an outlet of a prior art decanter centrifuge.

With reference to FIG. 2 the external opening of each liquid phase outlet passage 9 may according to the prior art be partly covered by a weir plate 14. The weir plate 14 determines the level 15 of liquid (cf. FIG. 3) in the bowl which substantially cannot exceed the overflow edge 17 of the weir plate, because the area 16 of the opening above the weir plate 14 from a practical view of the liquid is unlimited. The weir plate 14 is securely fixed to the base plate 6 by fastening means (not shown) in the form of e.g. bolts protruding through holes 18 in a peripheral part 19 of a supporting device 21. In the fixed state the peripheral part 19 covers at least part of the rim 20 of external opening of the liquid phase outlet passage 9, and the supporting device 21 partly covers the weir plate 14 to a level indicated by 22 on FIG. 2.

Figure 3:
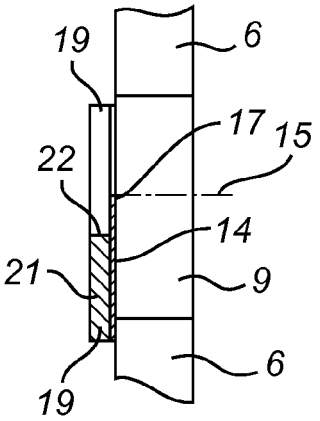
FIG. 3 shows a section along line III-III in FIG. 2.

FIG. 3 shows a cross section through the liquid phase outlet opening 9 along the line III-III in FIG. 2, indicating the level 15 of liquid, which substantially coincides with the overflow edge 17 of the weir plate 14.

Figure 4:
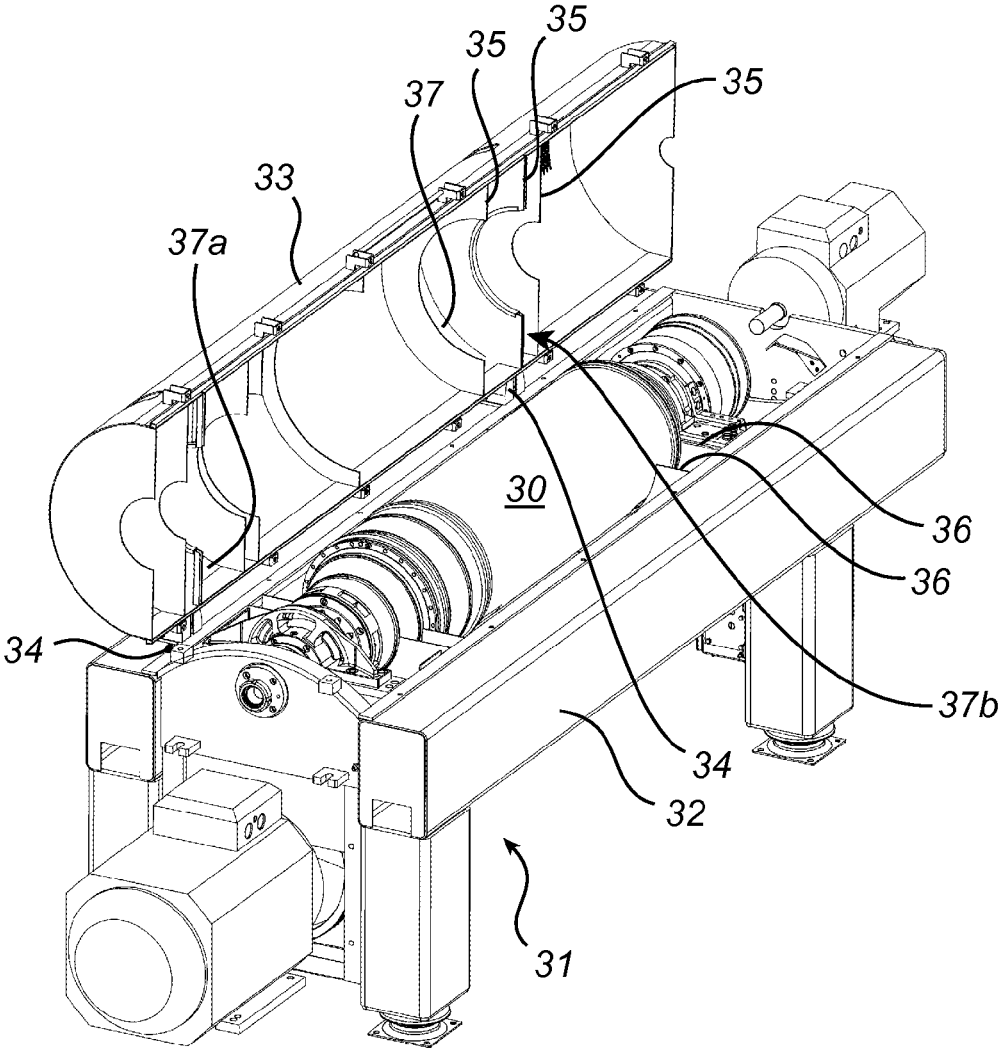
FIG. 4 shows a prior art decanter centrifuge with an open lid.

FIG. 4 shows for illustration a prior art decanter centrifuge comprising a rotating body 30 mounted in a casing 31 comprising a lower part 32 and a lid 33 hinged to the lower part 32 by means of hinges 34. The lid is shown in an open position. The casing comprises several partitions, which are sectioned whereby upper semicircular sections 35 of the partitions are attached to the lid 33 to cooperate with lower sections 36 of the partitions in the lower part 32 of the casing when the lid is brought into a closed position. These partitions divide the space between inner walls of the casing 31 and the rotating body 30 into compartments 37, some of which are used for collecting respective phases of the feed separated inside the rotating body 30. Thus a heavy phase compartment 37*a* collects a heavy solid phase and a light phase compartment 37*b* collects a light liquid phase.

Figure 5:
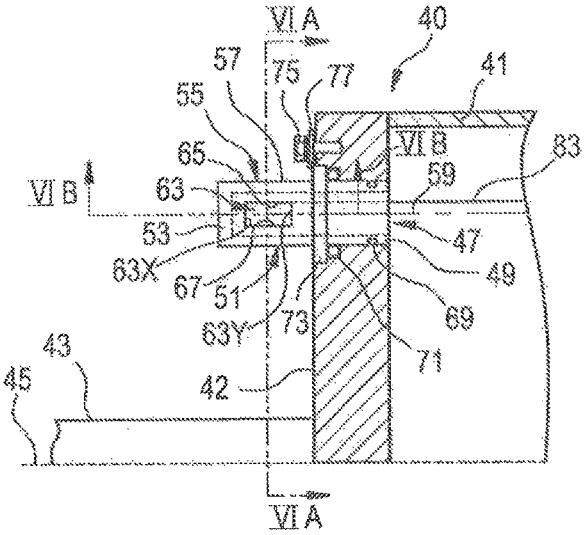
FIG. 5 shows a partial longitudinal section of an embodiment of an outlet according to the present invention.
Figure 6A:
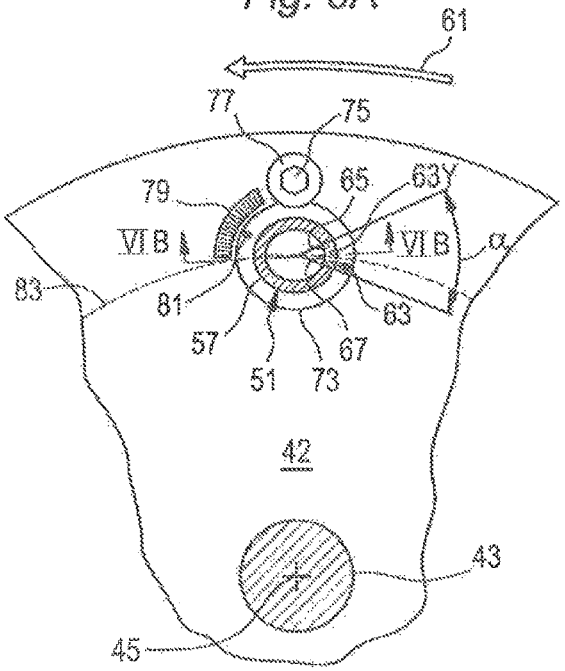
FIG. 6A shows a section along line VIA-VIA in FIG. 5.
Figure 6B:
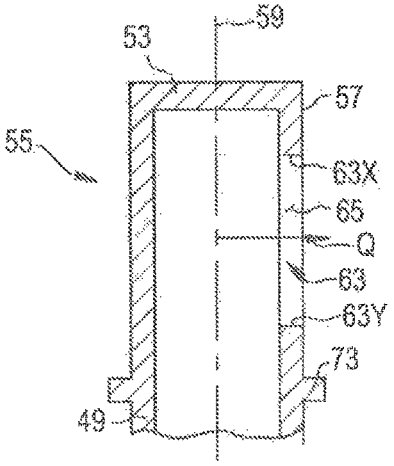
FIG. 6B shows a section along line VIB-VIB in FIGS. 5 and 6A.

FIGS. 5 and 6 illustrates part of a rotating body 40 comprising a bowl 41, a base plate or base 42, and a shaft part 43 connected to the base 42. The rotating body has a horizontal axis of rotation 45. So far the rotating body 40 may be similar to the rotating bodies 1 and 30 shown in FIGS. 1 and 4 respectively. However, according to an embodiment of the present invention, a liquid phase outlet passage 47 extending through the base 42 accommodates a circular connecting piece 49 of a tubular outlet element 51 with a blind (e.g., sealed) axial end 53.

The blind end 53 provides an outlet housing 55 with a circular cylindrical side wall 57. The outlet element 51 has an axis extending in parallel to the axis of rotation 45 and constituting an adjustment axis 59 as it will be explained in more detail below. In operation the rotating body 40 is rotating in a direction of rotation 61 as indicated in FIG. 6. The side wall 57 of the outlet housing 55 comprises an outlet opening 63 with a weir edge 65 and an opposite edge 67 that extend between a first axial inward facing surface 63X and a second axially inward facing surface 63Y. The weir edge 65 and the opposite edge 67 both extend along a respective generator of the cylinder surface of the cylindrical side wall 57. The weir edge 65 and the opposite edge 67 extend between them an angle α, which preferably is in the range 30° to 75°, more preferably 45° to 60°. The outlet housing 55 is rotatable around the adjustment axis 59 whereby the weir edge 65 is rotatable around the adjustment axis 59 while maintaining a parallel orientation to the adjustment axis 59. The outlet opening 63 extends an angle α between the weir edge 65 and an edge 67 on an opposite side of the outlet opening 63. The side wall 57 is offset from the adjustment axis 59 and the outlet opening 63 is present in the side wall 57 such that the angle α configures the outlet opening 63 in a general direction, indicated by the arrow Q, perpendicular to the adjustment axis 59. The weir edge 65 is selectively positionable, via rotation of the outlet housing, relative to a circumferential direction of rotation (e.g., see arrow labeled 61 in FIG. 6A) of the base 42 and the axis of rotation 45 of the rotating body.

In the embodiment shown the connecting piece 49 is substantially cylindrical like the outlet housing 55 apart from a grove accommodating an O-ring seal 69. Another O-ring seal 71 is accommodated in a recess surrounding the outlet passage 47. The outlet element 51 comprises a circumferential collar 73, which is partly accommodated in another recess surrounding the outlet passage 47. Being circular the connecting piece 49, and therewith the rest of the outlet element 51, is rotatable around the adjustment axis 59.

A screw 75 with a washer 77 is provided beside the outlet element 51 so that tightening the screw 75 urges the washer 77 against the collar 73 thereby clamping the same, whereby rotation of the outlet element 51 is prevented, the screw 75 and the washer 77 constituting an embodiment of a fastener.

Further a scale 79 is provided on the surface of the base 42 beside the recess accommodating the collar 73, and on the collar a mark 81 is provided giving an indication of the angular position of the outlet element 51, the scale 79 and the mark 81 together constituting an embodiment of an indicator.

Though only one outlet passage 47 is shown in FIGS. 5 and 6 it should be understood that a plurality of outlet passages will in this embodiment be present and evenly distributed around the axis of rotation as it is normal for such centrifugal separators.

The outlet housing 55 works as follows:

In use the bowl 41 rotates in the direction 61 causing a feed inside the bowl 41 to separate in a heavy solid phase (not shown) and a light liquid phase having a surface at a level 83, which is slightly above the level of the weir edge 65 thereby providing a pressure head driving the liquid phase out of the bowl through the outlet element 51 and the outlet opening 63. The outlet opening 63 should be so large that during normal use of the centrifugal separator it does not run full, but a free space or an air vent between the free surface of the flowing liquid and the opposite edge 67 will be present.

The outlet element 55 is put in an angular position by rotating it around the adjustment axis 59 to bring the weir edge 65 to a desired level corresponding to a desired level 83 of the liquid inside the bowl. If the latter level need to be adjusted the level of the weir edge 65 is adjusted correspondingly by rotating the outlet element 55 around the adjustment axis 59. Due to the circular movement of the adjustment raising the weir edge 65 will at a given point entail that the opposite edge 67 is lowered to a position close to or below the level of the weir edge 65 and at that point liquid will flow over the opposite edge 67 which is not intended. Thus there is a limit to the range within which the level of the weir edge can be adjusted. The larger the angle α is, the smaller is the range within which the level of the weir edge can be adjusted while obtaining the intended function. However the smaller the angle α is the smaller is also the size of the outlet opening 63. These are factors the skilled person will take into consideration when deciding the size of the angle α.

When adjusting the angular position of the outlet element 51 care is taken that the outlet opening 63, as shown in FIG. 6, is facing rearwards relative to the direction of rotation 61 in order to discharge the liquid phase in an opposite direction relative to the direction of rotation 61 whereby energy is recovered from the discharged liquid.

For adjustment of the angular position of the outlet element 51 the screw 75 is un-tightened to release the collar 73 from the clamping action of the washer 77. The outlet element is turned around the adjustment axis using the scale 79 and mark 81 to control the angle of adjustment, and the screw is tightened again to prevent unintended rotation of the outlet element 51.

Figure 7:
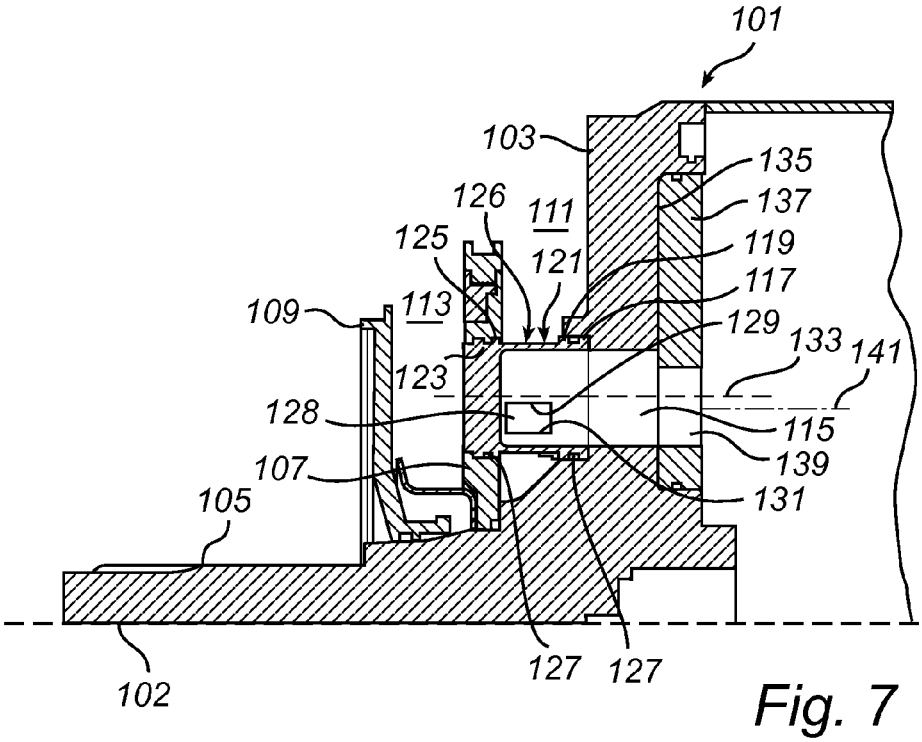
FIG. 7 shows a partial longitudinal section of a rotating body according to the present invention showing a first outlet.
Figure 8:
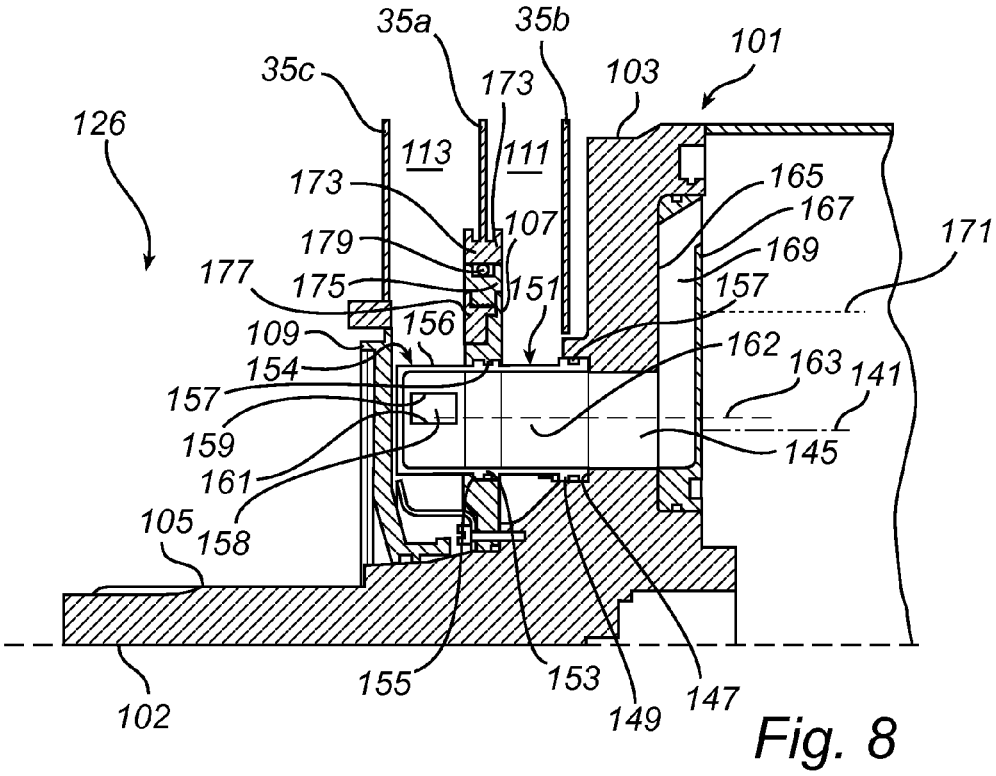
FIG. 8 shows a partial longitudinal section of the rotating body of FIG. 7 showing a second outlet.
Figure 9:
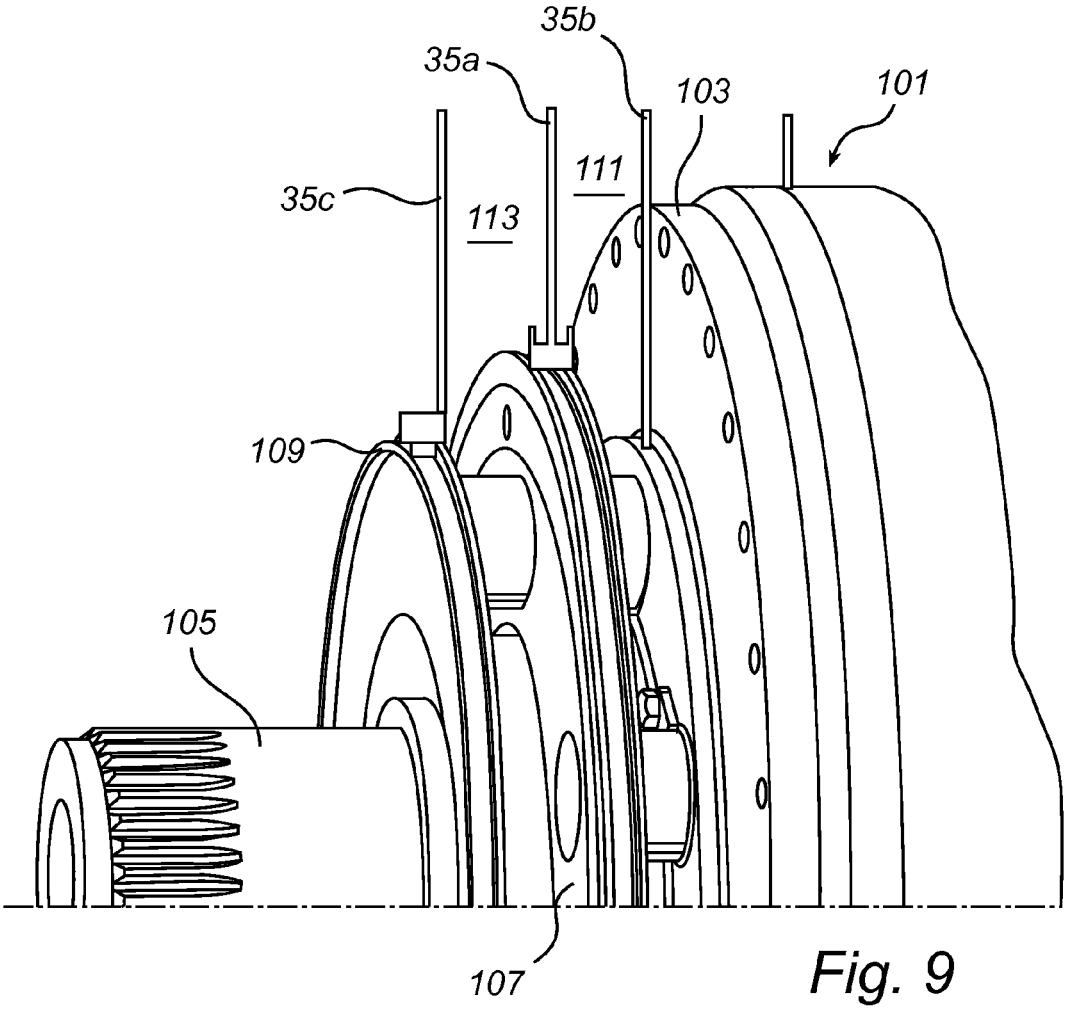
FIG. 9 shows a partial perspective view of the rotating body in FIGS. 7 and 8.

FIGS. 7 to 9 show a part of another embodiment of a rotating body 101 according to the invention. The parts not shown may be similar to corresponding parts of the embodiments shown in FIGS. 1 to 6. However the present embodiment is adapted for separating feeds wherein a liquid phase comprises a mixture of two liquid phases of different density. Thus elements the inside the bowl (not shown) may be similar to the elements inside the embodiments of a bowl disclosed in WO 2009/127212, which is incorporated herein by reference. The rotating body 101 has an axis of rotation 102 and comprises a base 103, which is connected with a shaft part 105, which carries a flange 107 and a shield 109. The base 103 and the flange 107 define between them a first rear longitudinal area 111 of the centrifugal separator, and the flange 107 and the shield 109 define between them a second rear longitudinal area 113 of the centrifugal separator. The base 103 is thus facing the first rear longitudinal area 111. By definition the first rear longitudinal area 111 is rear of the base 103, and the second rear longitudinal area 113 is rear of the first rear longitudinal area 111.

Partitions of a casing, which is not shown in detail, but which corresponds to the casing shown in FIG. 4, are indicated in FIGS. 8 and 9 by their upper sections 35*a*, 35*b* and 35*c*. Upper section 35*a* and the flange 107 defines together with upper section 35*b* a proximal compartment in the first rear longitudinal area 111, and upper section 35*a* and the flange 107 defines together with upper section 35*c* and the shield 109 a distal compartment in the second rear longitudinal area 113.

Being adapted for feeds comprising two liquid phases the base 103 comprises two outlet passages provided at different angular positions relative to the axis of rotation 102.

Thus FIG. 7 shows a first outlet passage 115 with a recess 117 accommodating a connecting piece 119 of a first circular outlet element 121. A blind end of the outlet element 121 is formed as a connecting piece 123 accommodated in an opening 125 in the flange 107. Thus the outlet element 121 is held by the base 103 and the flange 107. O-ring seals 127 are provided in respective grooves in the connecting pieces 119 and 123. The part of the outlet element 121 between the connecting pieces 119 and 123 constitutes a circular cylindrical side wall of an outlet housing 126 with a first outlet opening 128 having a first weir edge 129 and an opposite edge 131. The first outlet housing 126 is rotatable around an adjustment axis 133 as the connecting pieces 119 and 123 are circular. In an inner surface of the base a recess 135 is provided at the outlet passage 115. The recess 135 accommodates a channel member 137 with a through passage 139 opening into the outlet passage 115.

Thus in use the outlet housing 126 with its weir edge 129 works similar to the outlet housing 55 described with reference to FIGS. 5 and 6, the weir edge 129 defining a level 141 of liquid inside the bowl. Thus, in use the light phase of the liquid from the bowl will be discharged from the first outlet 128 into the proximal compartment in the first rear longitudinal area 111.

It should however be noted that the orientation of the outlet opening 128 indicates that the direction of rotation of the rotating body in this embodiment is opposite to the direction of rotation of the rotating body of the embodiment shown in FIGS. 5 and 6.

FIG. 8 shows a second outlet passage 145 with a recess 147 accommodating a connecting piece 149 of a second circular outlet element 151. A blind end of the outlet element 151 is formed as a second outlet housing 154 with a circular cylindrical side wall 156, which comprises a second outlet opening 158 with a second weir edge 159 and an opposite edge 161 both of which extend along a respective generator of the cylinder surface of the cylindrical side wall 156. The outlet element 151 is provided with an intermediate connecting piece 153 accommodated in an opening 155 with a recessed shoulder in the flange 107. Thus the outlet element 151 is held by the base 103 and the flange 107. O-ring seals 157 are provided in respective grooves in the connecting pieces 149 and 153. The part of the outlet element 151 between the connecting pieces 149 and 153 constitutes a tubular conduit 162. The second outlet housing 154 is rotatable around an adjustment axis 163 as the connecting pieces 149 and 153 are circular. In an inner surface of the base a recess 165 is provided at the second outlet passage 145. The recess 165 accommodates a second channel member 167 with a passage 169 connecting a lower level in the bowl, where a heavy liquid phase is present, with the second outlet passage 145. Thus the second channel member 167 shields in use the second outlet passage 145 from the light liquid phase in the bowl.

In use the second outlet housing 154 with its weir edge 159 works similar to the outlet housing 55 described with reference to FIGS. 5 and 6 and similar to the outlet housing 126 described with reference to FIG. 7. However the weir edge 159 is not defining the level 141 of liquid inside the bowl, but is together with the first weir edge 129 defining the level 171 of an interface between given light and heavy liquid phases in the bowl. The skilled person will understand that the actual level 171 of said interface also depends on the rate between the densities of the light and the heavy phase. Thus, in use the heavy phase of the liquid from the bowl will be discharged from the second outlet 158 into the distal compartment in the second rear longitudinal area 113.

Being in the present embodiment parts of a unitary element the second outlet housing 154 and the tubular conduit 162 constitute an elongate outlet housing having a first axial length and the second outlet opening 158 extends a second axial length, which is less than half the first axial length. Thereby the second outlet opening 158 is placed remote from the base 103. This provides for discharging one of the liquid phases in the second rear longitudinal area 113 next to the first rear longitudinal area 111, while discharging said liquid phase at a level close to the level of the liquid inside the bowl, which assists minimizing loss of energy. Discharging the liquid in a direction opposite the direction of rotation assists minimizing further the loss of energy or entails recovery of energy from the rotating body of liquid in the bowl.

For adjustment of the levels 141 and 171 the first and the second outlet elements 121 and 151 are rotated around their respective adjustment axis 133 and 163 using indicators not shown to control the rotation and un-tightening fasteners not shown to allow the rotation. This is similar to the adjustment described with reference to the embodiment shown in FIGS. 5 and 6.

While in the embodiment shown in and discussed with reference to FIGS. 7 to 9, the light phase is discharged into the proximal compartment and the heavy phase is discharged into the distal compartment, this could be changed by interchanging the channel members 137 and 167 and by corresponding readjustment of the levels of the first and the second weir edge 129 and 159, whereby the heavy phase is discharged into the proximal compartment and the light phase is discharged into the distal compartment.

In order to prevent re-mixing of the two liquid phases after discharge from the respective outlet openings 128 and 158 a seal is provided between the flange 107 and a partition of the casing cooperating therewith. FIGS. 8 and 9 show an upper section 35*a* of said partition, which comprises a foot portion 173. The flange 107 carries an inner annular sealing member 175 mounted by means of an annular holding element 177 attached to the flange 107. The annular sealing member 175 is in sliding engagement with the flange 107 and it is preferably made of a relative hard plastics material. The annular sealing member 175 has a groove accommodating an outer flexible member in the form of an O-ring seal 179. When the lid of the casing is in its closed position, as indicated in FIGS. 8 and 9 by the position of the upper section 35*a* of the partition, the foot portion 173 press against the O-ring seal 179 and prevents rotation of the annular sealing member 175 while the sliding engagement of the annular sealing member 175 with the flange 107 allows the rotating body 101 to rotate. This sealing construction may also be used between other partitions and corresponding parts of the rotating body.

The above detailed description is not limited to the mentioned embodiments of the invention but to a person skilled in the art there are several modifications possible within the scope of the claimed invention.

What is claimed is:

1. A centrifugal separator comprising:

a rotating body rotating in use in a direction of rotation around an axis of rotation, said axis of rotation extending in a longitudinal direction of said rotating body, said rotating body comprising a bowl, said bowl comprising a base provided at one longitudinal end of said bowl, said base facing a first rear longitudinal area of the centrifugal separator rear of said base;

a first outlet passage extending through said base; and a first outlet housing provided in said first rear longitudinal area, said first outlet housing communicating with the first outlet passage to receive liquid from said first outlet passage and said first outlet housing having a first outlet opening discharging in use liquid from the rotating body, said first outlet opening comprising a first weir edge defining in normal use a level of a surface of a liquid in the bowl, wherein said first outlet housing is rotatable around a first adjustment axis whereby the first weir edge is rotatable around the first adjustment axis while maintaining a parallel orientation to the first adjustment axis and the first outlet opening extends an angle between the weir edge and an edge on an opposite side of the first outlet opening, and said first outlet housing comprises a first side wall offset from the first adjustment axis, the first outlet opening being present in said first side wall such that the angle configures the first outlet opening in a direction perpendicular to the first adjustment axis and the weir edge being positionable, via rotation of the outlet housing, relative to a circumferential direction of rotation of the base and the axis of rotation of the rotating body in order to discharge the liquid in an opposite direction relative to the direction of rotation whereby energy is recovered from the discharged liquid.

2. The centrifugal separator according to claim 1, wherein the first outlet housing is cylindrical having a cylinder surface provided by said first side wall and a cylinder axis coaxial with the adjustment axis.

3. The centrifugal separator according to claim 2, wherein the first outlet housing is circular cylindrical.

4. The centrifugal separator according to claim 1, wherein the angle is 30° to 75°, around the adjustment axis.

5. The centrifugal separator according to claim 2, wherein the first weir edge extends along a generator of the cylinder surface.

6. The centrifugal separator according to claim 1, wherein the first outlet housing has an axial length in the direction of the adjustment axis, and the first outlet opening is extending an axial length in the direction of the adjustment axis shorter than the axial length of the first outlet housing.

7. The centrifugal separator according to claim 1, wherein the first outlet housing is part of an outlet element having a connecting piece rotatably connected to the base.

8. The centrifugal separator according to claim 7, wherein the outlet element is tubular, having an outer circumferential collar separating the outlet housing and the connecting piece.

9. The centrifugal separator according to claim 1, comprising an indicator indicating the angular position of the outlet housing relative to the adjustment axis.

10. The centrifugal separator according to claim 1, comprising a fastener for preventing rotation of the outlet housing around the adjustment axis.

11. The centrifugal separator according to claim 1, wherein the adjustment axis is parallel to the axis of rotation.

12. The centrifugal separator according to claim 1, wherein a second outlet passage is extending through the base, said second outlet passage communicating with a conduit extending to a second outlet opening discharging in use liquid from the rotating body in a second rear longitudinal area rear of the first rear longitudinal area, said conduit comprising a second outlet housing located rear of said first outlet housing in the second rear longitudinal area, the second outlet housing being rotatable around a second adjustment axis, said second outlet housing comprising a side wall offset from said second adjustment axis, the second outlet opening being placed in said side wall.

13. The centrifugal separator according to claim 12, wherein a shaft part of the rotating body extends coaxially with the axis of rotation from the base, the shaft part carries a flange, the conduit extends through the flange, and the second outlet opening is provided on a distal side of the flange relative to the bowl, the flange separating the first and the second rear longitudinal area.

14. The centrifugal separator according to claim 12, comprising a casing housing the rotating body, said casing comprising a proximal compartment for receiving a liquid discharged from the rotating body through the first outlet opening, and a distal compartment for receiving liquid discharged from the rotating body through the second outlet opening, said casing comprising a partition that separates said compartments.

15. The centrifugal separator according to claim 13, comprising a casing housing the rotating body, said casing comprising a proximal compartment for receiving a liquid discharged from the rotating body through the first outlet opening, and a distal compartment for receiving liquid discharged from the rotating body through the second outlet opening, said compartments being separated by a partition, wherein the flange is surrounded by an annular sealing, that the casing including the partition is divided in at least two parts comprising a lid, and the partition engages the annular sealing, when the lid is in a closed position.

16. An outlet element for a centrifugal separator having a base at one longitudinal end of a bowl of the centrifugal separator, the base facing a rear longitudinal area of the centrifugal separator, rear of the base, the outlet element comprising an outlet housing and a connecting piece, the connecting piece providing for rotatable connection of the outlet element to the base of the centrifugal separator for the outlet element to be rotatable around an adjustment axis and the outlet housing to extend rear of said base, the outlet housing comprising a side wall offset from said adjustment axis, an outlet opening provided in said side wall, said outlet opening comprising a weir edge, whereby the first weir edge is rotatable around the first adjustment axis while maintaining a parallel orientation to the first adjustment axis and the outlet opening extends an angle between the weir edge and an edge on an opposite side of the outlet opening, and the angle configures the outlet opening in a direction perpendicular to the adjustment axis and the weir edge being positionable, via rotation of the outlet housing, relative to a circumferential direction of rotation of the base and an axis of rotation of the centrifugal separator.

17. The outlet element according to claim 16, wherein the outlet housing is cylindrical having a cylinder surface provided by said side wall and a cylinder axis coaxial with the adjustment axis.

18. The outlet element according to claim 17, wherein the outlet housing is circular cylindrical.

19. The outlet element according to claim 16, wherein the angle is 30° to 75°.

20. The outlet element according to claim 17, wherein the weir edge is extending along a generator of the cylinder surface.

21. The outlet element according to claim 16, wherein the outlet housing has an axial length in the direction of the adjustment axis, and the outlet opening is extending an axial length in the direction of the adjustment axis shorter than the axial length of the outlet housing.

22. The outlet element according to claim 16, wherein the outlet element is tubular, having an outer circumferential collar separating the outlet housing and the connecting piece.

23. The outlet element according claim 16, wherein the angle is 45° to 60°.

24. The centrifugal separator according to claim 1, wherein the angle is 45° to 60°.

25. The centrifugal separator according to claim 1, wherein the first outlet housing is communicating with the first outlet passage through a conduit, said conduit comprising said first outlet housing, and a second outlet passage is extending through the base, said second outlet passage communicating with a second outlet opening discharging in use liquid from the rotating body in a second rear longitudinal area intermediate of the first rear longitudinal area and the base of the bowl, a second outlet housing located rear of said first outlet housing in the second rear longitudinal area, the second outlet housing being rotatable around a second adjustment axis, said second outlet housing comprising a second side wall offset from said second adjustment axis, the second outlet opening being placed in said second side wall.

26. The centrifugal separator according to claim 1, wherein the first outlet housing comprises a blind axial end that is sealed.

27. The centrifugal separator according to claim 16, wherein the outlet housing comprises a blind axial end that is sealed.

28. The centrifugal separator according to claim 1, wherein first weir edge is perpendicular to the base.

29. The centrifugal separator according to claim 16, wherein the weir edge is perpendicular to the base.

* * * * *